US006202441B1

(12) United States Patent
Ha

(10) Patent No.: US 6,202,441 B1
(45) Date of Patent: Mar. 20, 2001

(54) CRYOGENIC DISTILLATION SYSTEM FOR AIR SEPARATION

(75) Inventor: Bao Ha, San Ramon, CA (US)

(73) Assignees: Air Liquide Process and Construction, Inc., Houston, TX (US); L'Air Liquide, Societe Anonyme pour l'Etude et, l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/317,994

(22) Filed: May 25, 1999

(51) Int. Cl.[7] ..... F25J 3/00
(52) U.S. Cl. ..... 62/646; 62/924
(58) Field of Search ..... 62/646, 640, 643, 62/647, 648, 924

(56) References Cited

U.S. PATENT DOCUMENTS

| | | | | |
|---|---|---|---|---|
| 1,880,981 | | 10/1932 | Pollitzer et al. . | |
| 4,433,989 | * | 2/1984 | Erickson | 62/646 |
| 5,224,045 | | 6/1993 | Stasell . | |
| 5,231,837 | | 8/1993 | Ha . | |
| 5,245,832 | | 9/1993 | Roberts . | |
| 5,257,504 | | 11/1993 | Agrawal et al. . | |
| 5,331,818 | | 7/1994 | Rathbone . | |
| 5,341,646 | | 8/1994 | Agrawal et al. . | |
| 5,438,835 | | 8/1995 | Rathbone . | |
| 5,513,497 | | 5/1996 | Agrawal et al. . | |
| 5,644,934 | | 7/1997 | Pompl . | |
| 5,666,823 | | 9/1997 | Smith et al. . | |
| 5,675,977 | | 10/1997 | Prosser . | |
| 5,678,426 | | 10/1997 | Agrawal et al. . | |
| 5,682,764 | | 11/1997 | Agrawal et al. . | |
| 5,689,975 | * | 11/1997 | Oakey et al. | 62/653 |
| 5,692,395 | | 12/1997 | Agrawal et al. . | |
| 5,868,007 | | 2/1999 | Higginbotham . | |

FOREIGN PATENT DOCUMENTS

| | | | | |
|---|---|---|---|---|
| 0 286 314 | | 10/1988 | (EP) . | |
| 0 636 845 | | 2/1995 | (EP) . | |
| 0 684 438 | | 11/1995 | (EP) . | |
| 0 694 745 | | 1/1996 | (EP) . | |
| 833118 | * | 4/1998 | (EP) | 62/924 |

* cited by examiner

*Primary Examiner*—William Doerrler
(74) *Attorney, Agent, or Firm*—Young & Thompson

(57) ABSTRACT

Air is separated by cryogenic distillation comprising the steps of feeding compressed, cooled and purified air to a high pressure column where it is separated into a first nitrogen enriched stream at the top and a first oxygen enriched stream at the bottom. At least a portion of the first oxygen enriched stream is fed to an intermediate pressure column to yield a second nitrogen enriched stream at the top and a second oxygen enriched stream at the bottom. At least a portion of the second nitrogen enriched stream is sent to a low pressure column or to a top condenser of an argon column, and at least a portion of the second oxygen enriched stream is sent to the low pressure column. A third oxygen enriched stream is separated at the bottom and a third nitrogen enriched stream is separated at the top of the low pressure column. A heating gas is sent to a bottom reboiler of the low pressure column, and at least a portion of the third oxygen enriched stream is removed at a removal point. A first argon enriched stream containing between 3 and 20% argon is removed from the low pressure column, and the first argon enriched stream is sent to the argon column having a top condenser. A second argon enriched stream, richer in argon than the first argon enriched stream, is recovered at the top of the argon column and a fourth oxygen enriched stream is removed at the bottom of the argon column. The argon column operates at a pressure at least 0.5 bar lower than the pressure of the low pressure column.

44 Claims, 5 Drawing Sheets

CRYOGENIC DISTILLATION SYSTEM FOR AIR SEPARATION

BACKGROUND OF THE INVENTION

Figure 1:
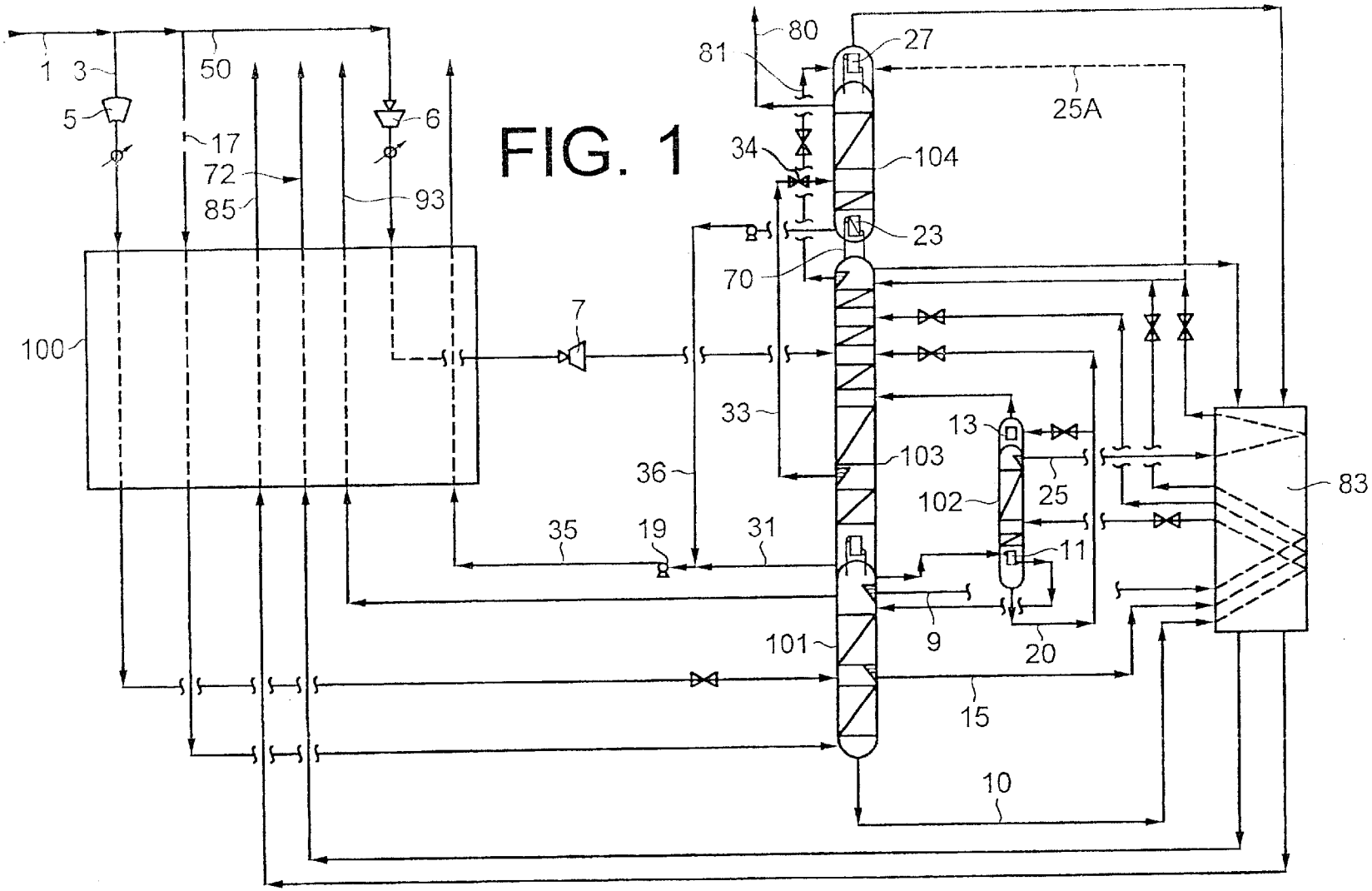

This invention applies in particular to the separation of air by cryogenic distillation. Over the years numerous efforts have been devoted to the improvement of this production technique to lower the oxygen cost which consists mainly of the power consumption and the equipment cost.

It has been known that an elevated pressure distillation system is advantageous for cost reduction and when the pressurized nitrogen can be utilized the power consumption of the system is also very competitive. It is useful to note that an elevated pressure system is characterized by the fact that the pressure of the lower pressure column being above 2 bar absolute. The conventional or low pressure process meanwhile has its lower pressure column operating at slightly above atmospheric pressure.

The higher the pressure of the lower pressure column, the higher is the air pressure feeding the high pressure column and the more compact is the equipment for both warm and cold portions of the plant resulting in significant cost reduction. However, the higher the pressure, the more difficult is the distillation process since the volatilities of the components present in the air (oxygen, argon, nitrogen etc) become closer to each other such that it would be more power intensive to perform the separation by distillation. Therefore the elevated pressure process is well suited for the production of low purity oxygen (<98% purity) wherein the separation is performed between the easier oxygen-nitrogen key components instead of the much more difficult oxygen-argon key components. The volatility of oxygen and argon is so close such that even at atmospheric pressure it would require high number of distillation stages and high reboil and reflux rates to conduct such separation. The elevated pressure process in the current configuration of today's state-of-the-art process cycles is not suitable nor economical for high purity oxygen production (>98% purity). Since the main impurity in oxygen is argon, the low purity oxygen production implies no argon production since over 50% of argon contained in the feed air is lost in oxygen and nitrogen products.

Therefore it is advantageous to come up with an elevated pressure process capable of high purity oxygen production and also in certain cases argon production.

The new invention described below utilizes the basic triple-column process developed for the production of low purity oxygen and adds an argon column to further separate the low purity oxygen into higher purity oxygen along with the argon by-product. By adding the argon column one can produce high purity oxygen (typically in the 99.5% purity by volume) required for many industrial gas applications and at the same time produce argon which is a valuable product of air separation plants.

The elevated pressure double-column process is described in U.S. Pat. No. 5,224,045.

The triple-column process is described in U.S. Pat. No. 5,231,837 and also in the following publications:

U.S. Pat. Nos. 5,257,504, 5,438,835, 5,341,646, EP 636845A1, EP 684438A1, U.S. Pat. Nos. 5,513,497, 5,692, 395, 5,682,764, 5,678,426, 5,666,823, 5,675,977, 5,868,007, EP 833118 A1.

U.S. Pat. No. 5,245,832 discloses a process wherein a double-column system at elevated pressure is used in conjunction with a third column to produce oxygen, nitrogen and argon. In order to perform the distillation at elevated pressure a nitrogen heat pump cycle is used to provide the needed reboil and reflux for the system. In addition to the power required for the separation of argon and oxygen in the third column the heat pump cycle must also provide sufficient reflux and reboil for the second column as well such that the resulting recycle flow and power consumption would be high.

U.S. Pat. No. 5,331,818 discloses a triple column process at elevated pressure wherein the lower pressure columns are arranged in cascade and receive liquid nitrogen reflux at the top. The second column exchanges heat at the bottom with the top of the high pressure column. The third column exchanges heat at the bottom with the top of the second column. This process allows to optimize the cycle efficiency in function of the ratio of low pressure to high pressure nitrogen produced.

None of the above processes can be used economically and efficiently to produce high purity oxygen or argon.

U.S. Pat. No. 4,433,989 discloses an air separation unit using a high pressure column, an intermediate pressure column and a low pressure column, the bottom reboilers of the low and intermediate pressure columns being heated by gas from the high pressure column. Gas from the low pressure column feeds an argon column whose top condenser is cooled using liquid from the bottom of the intermediate pressure column. In this case the intermediate pressure column has no top condenser and all the nitrogen from that column is expanded to produce refrigeration.

U.S. Pat. No. 5,868,007 discloses a triple column system using an argon column operating at approximately the same pressure as the low pressure column. Gas from the bottom of the argon column is used to reboil the intermediate pressure column.

According to the invention, there is provided a process for separating air by cryogenic distillation comprising the steps of feeding compressed, cooled and purified air to a high pressure column where it is separated into a first nitrogen enriched stream at the top and a first oxygen enriched stream at the bottom, feeding at least a portion of the first oxygen enriched stream to an intermediate pressure column to yield a second nitrogen enriched stream at the top and a second oxygen enriched stream at the bottom, sending at least a portion of the second nitrogen enriched stream to a low pressure column or to a top condenser of the argon column, sending at least a portion of the second oxygen enriched stream to the low pressure column, separating a third oxygen enriched stream at the bottom and a third nitrogen enriched stream at the top of the low pressure column, sending a heating gas to a bottom reboiler of the low pressure column, removing at least a portion of the third oxygen enriched stream at a removal point, removing a first argon enriched stream containing between 3 and 20% argon from the low pressure column, sending the first argon enriched stream to an argon column having a top condenser, recovering a second argon enriched stream, richer in argon than the first argon enriched stream, at the top of the argon column and removing a fourth oxygen enriched stream at the bottom of the argon column wherein the argon column operates at a pressure at least 0.5 bar lower than the low pressure column.

It is useful to note that when a stream is defined as a feed to a column, its feed point location, if not specified, can be anywhere in the mass transfer and heat transfer zones of this column wherever there is direct contact between this stream and an internal fluid stream of the column. The bottom reboiler or top condenser are therefore considered as part of the column. As an example, a liquid feed to a bottom reboiler of the column is considered as a feed to this column.

According to further optional aspects of the invention:

the process comprises sending at least a portion of the second nitrogen enriched liquid stream to the low pressure column, at least partially vaporizing a portion of the second oxygen enriched liquid stream in the top condenser of the intermediate column, sending at least a portion of the at least partially vaporized second oxygen enriched stream and a portion of the second oxygen enriched liquid to the low pressure column, the argon column has a bottom reboiler heated by a gas stream, that gas stream contains at least 90% nitrogen, the gas stream heating the bottom reboiler of the argon column is at least a portion of one of the first, second and third nitrogen enriched streams, the process comprises compressing at least a portion of the nitrogen enriched gas stream and sending it as heating gas to the bottom reboiler of the argon column, the process comprises sending the fourth oxygen enriched stream to the low pressure column, the process comprises removing the first argon enriched stream at the bottom of the low pressure column, the process comprises removing the third oxygen enriched stream and the second argon enriched stream as products, the third oxygen enriched stream contains at least 95% oxygen and the second argon enriched stream contains at least 95% argon, the process comprises removing the first argon enriched stream at least 5 theoretical trays above the bottom of the low pressure column and removing the fourth oxygen enriched stream as a product, the process comprises removing the first argon enriched stream at least 20 theoretical trays above the bottom of the low pressure column, the process comprises removing the first argon enriched stream at most 30 theoretical trays above the bottom of the low pressure column, the fourth oxygen enriched stream contains at least 95% oxygen, the process comprises sending nitrogen enriched liquid from the top of the low pressure column to the top condenser of the argon column, the heating gas for the bottom reboiler of the low pressure column is nitrogen enriched gas from the high pressure column or air, oxygen enriched streams of differing purities are removed from the low pressure column, the low pressure column operates at above 2 bar, preferably above 3 bar and most preferably above 4 bar, the argon column operates at a pressure at least 1 bar lower than the pressure of the low pressure column, the intermediate pressure column has a bottom reboiler, the process comprises sending a nitrogen enriched gas from the high pressure column to the bottom reboiler, the process comprises at least partially vaporizing or subcooling at least part of the second nitrogen enriched fluid before sending it to the low pressure column, the process comprises at least partially vaporizing or subcooling at least part of the second oxygen enriched fluid before sending it to the low pressure column, the intermediate pressure column has a top condenser and the process comprises sending at least part of the second oxygen enriched fluid to the top condenser, air is sent to the intermediate pressure column.

According to a further aspect of the invention, there is provided an apparatus for separating air by cryogenic distillation comprising a high pressure column, an intermediate pressure column, a low pressure column having a bottom reboiler and an argon column having a top condenser, a conduit for sending air to the high pressure column, a conduit for sending at least part of a first oxygen enriched liquid from the high pressure column to the intermediate pressure column, a conduit for sending a second oxygen enriched fluid from the bottom of the intermediate pressure column to the low pressure column, a conduit for sending a second nitrogen enriched fluid from the top of the intermediate pressure column to the low pressure column or to a top condenser of the argon column, a conduit for sending a heating gas to the bottom reboiler of the low pressure column, a conduit for removing a third oxygen enriched fluid from the low pressure column, a conduit for sending a nitrogen enriched liquid from the high pressure column to the low pressure column, a conduit for sending a first argon enriched stream from the low pressure column to the argon column, a conduit for withdrawing a second argon enriched stream containing at least 50% argon from the argon column, a conduit for withdrawing a fourth oxygen enriched stream from the argon column and means for expanding the first argon enriched stream sent from the low pressure column to the argon column, preferably constituted by a valve.

According to further options:

the argon column has a bottom reboiler, there is a conduit for sending a third nitrogen enriched stream from the low pressure column to the bottom reboiler of the argon column, there is a compressor for compressing the third nitrogen enriched stream before sending it to the bottom reboiler of the argon column, there is a conduit for sending a nitrogen enriched liquid from the top of the low pressure column to the top condenser of the argon column, the conduit for removing the first argon enriched stream is connected to the bottom of the low pressure column, there is a conduit for sending the fourth oxygen enriched stream to an intermediate point of the low pressure column, there are means for pressurizing at least one oxygen enriched liquid withdrawn from the argon column or the low pressure column, there are conduits for withdrawing oxygen enriched streams of differing purities from the low pressure column, the conduit for removing the first argon enriched stream is connected to an intermediate level of the low pressure column, there are means for at least partially vaporizing or subcooling the second nitrogen enriched liquid before sending it to the low pressure column, there are means for at least partially vaporizing or subcooling the second oxygen enriched liquid before sending it to the low pressure column, the intermediate pressure column has a bottom reboiler, there are means for sending a nitrogen enriched gas from the high pressure column to the bottom reboiler of the intermediate pressure column, the intermediate pressure column has a top condenser, there are means for sending at least part of the second oxygen enriched fluid to the top condenser of the intermediate pressure column, there are means for sending air to the intermediate pressure column.

The new invention addresses this aspect by adding a argon column operated at relatively lower pressure to the elevated pressure triple-column column process to perform an efficient separation of argon and oxygen which is a necessity for the production of high purity oxygen and/or argon production.

In one embodiment (FIG. 1) the process can be described as follows:

Air free of impurities such as moisture and CO2 is fed to a high pressure column where it is separated into a nitrogen rich stream at the top and an oxygen rich stream at the bottom.

Feed at least a portion of the oxygen rich stream to a side column to yield a second nitrogen rich stream at the top and a second oxygen rich stream at the bottom. This side column has a reboiler which exchanges heat with the nitrogen rich gas at or near the top of the high pressure column. Recover a portion of the second nitrogen rich stream as liquid reflux and feed it to the low pressure column.

At least partially vaporize at least a portion of the second oxygen rich stream in the overhead condenser of the side column and feed this vaporized stream and the non-vaporized portion to the low pressure column.

The low pressure column separates its feeds into a third oxygen rich stream at the bottom and a third nitrogen rich stream at the top. The bottom of the low pressure column exchanges heat with the top of the high pressure column. Recover at least a portion of the $3^{rd}$ oxygen rich stream as oxygen product.

Extract an oxygen-argon stream above the $3^{rd}$ oxygen rich stream. Feed this oxygen-argon stream to the argon column. Recover an argon stream at the top of the argon column and a $4^{th}$ oxygen rich stream at the bottom of the argon column.

DETAILED DESCRIPTION OF THE INVENTION

FIGS. 1 to 5 show flow diagrams for different air separating processes according to the invention, all of which can be used to produce oxygen containing at least 98% oxygen and preferably more than 99% oxygen.

In the embodiment of FIG. 1, feed air 1 substantially free of moisture and CO2 is divided into three streams 3, 17, 50 each of which are cooled in the main exchanger 100. Air stream 3 is compressed in a booster 5 before cooling, traverses heat exchanger 100, is expanded in a valve or a liquid turbine and fed to a high pressure column 101 in liquid form. Stream 17 is cools in heat exchanger 100 and is fed to the high pressure column 101 in gaseous form. Stream 50 is compressed in a booster 6 and partially cooled in heat exchanger 100 before being expanded in turbine 7 and sent to the low pressure column 103. Of course alternatively or additionally refrigeration could be provided by a Claude turbine (i.e. a turbine sending air to the high pressure column) or a turbine expanding gas from one or several of the columns 101, 102, 103. First oxygen enriched stream 10 extracted from column 101 is subcooled in subcooler 83, expanded and sent to an intermediate level of intermediate pressure column 102 wherein it is separated into a second oxygen enriched stream 20 and a second nitrogen enriched stream at the top. A portion of the second nitrogen enriched stream is extracted as liquid reflux 25 and sent to the top of the low pressure column. Alternatively all or part of this stream may be sent to the top condenser 27 of argon column 104 as shown in dashed line 25A.

A portion 9 of a first nitrogen enriched gas from the high pressure column 101 is sent to the bottom reboiler 11 of the intermediate pressure column 102, condensed and sent back to the high pressure column as reflux. Other heating fluids such as gas from lower down the high pressure column could be envisaged.

Part of the first nitrogen enriched gas from the high pressure column 101 is used to heat the bottom reboiler 8 of the low pressure column.

Part of the second oxygen enriched stream 20 is sent to the low pressure column following expansion and the rest is sent to the top condenser 13 of the intermediate pressure column 102 where it vaporizes and is sent to the low pressure column 103 a few trays below the other part of stream 20.

A nitrogen enriched stream 15 is removed below stream 9 or from the same level as stream 9, expanded and sent to the low pressure column. In this case no nitrogen enriched liquid is sent from the high pressure column to the intermediate pressure column.

The low pressure column 103 separates its feeds into a third oxygen rich stream 31 containing at least 95% oxygen at the bottom and a third nitrogen rich stream at the top. Liquid stream 31 is pumped in pump 19 and sent to the heat exchanger 100 where it vaporizes to form gaseous oxygen product.

The liquid oxygen may of course be vaporized in a distinct product vaporizer by heat exchange with air or nitrogen only.

It is also possible to produce liquid nitrogen under pressure by removing liquid nitrogen from one of the columns, pumping it and vaporizing it in heat exchanger 100 or elsewhere.

The intermediate pressure column is operated at a pressure lower than the high pressure column pressure but higher than the low pressure column pressure.

A first argon enriched stream 33 containing between 3 and 20% argon is extracted in liquid form above the bottom stream 31. Stream 33 comprising principally oxygen and argon is expanded in a valve 34 and is fed to an intermediate level of the argon column 104 wherein it is separated into a argon stream 80 at the top and a fourth oxygen enriched stream 36 at the bottom. Liquid stream 36 is pumped to the pressure of stream 31 and mixed therewith. In this embodiment the argon column operates at a lower pressure than the low pressure column and is reboiled by nitrogen rich stream 70, containing at least 90% nitrogen and preferably at least 95% nitrogen, from the top of the low pressure column sent to bottom reboiler 23 and then returned to the top of low pressure column 103.

In this case the argon is crude but if necessary additional trays could be used in the argon column to produce high purity argon (99.9999%).

The top condenser 27 of the argon column is cooled using expanded nitrogen enriched liquid 81 from the top of the low pressure column 103 containing at least 90% nitrogen and preferably at least 95% nitrogen. This liquid may be supplemented or replaced by liquid extracted from a tray below the top tray of the low pressure column or stream 25A containing at least 90% nitrogen from the intermediate pressure column 102. The location of the tray where the liquid can be extracted can be as much as twenty theoretical trays below the top tray for example. of course a nitrogen rich liquid extracted from the top of the high pressure column or at a tray below the top of the high pressure column can also be sent to this condenser to perform the cooling as well. The vaporized liquid is warmed in subcooler 83 and then in heat exchanger 100 to form low pressure nitrogen 85.

Nitrogen enriched gas from the top of the low pressure column is also warmed in exchangers 83, 100 to form medium pressure nitrogen 72.

High pressure nitrogen 93 is removed from the high pressure column and sent to heat exchanger 100.

Additionally or alternatively, liquid nitrogen may be removed from one of the columns, pumped and vaporized in the heat exchanger 100. Liquid argon may be removed from the argon column 104.

Liquids may also be produced as final products.

Example: to illustrate the process of FIG. 1, a simulation was conducted to show the key streams of the new invention:

| | 1 | 31 | 33 | 36 | 72 | 85 | 80 |
|---|---|---|---|---|---|---|---|
| Flow | 1000 | 85 | 130 | 122.4 | 400 | 385 | 7.60 |
| Pressure, bar abs | 15.1 | 5.02 | 5.00 | 5.0 | 4.69 | 2.78 | 1.24 |
| Temperature ° C. | 45 | −164.3 | −164.7 | −180.5 | 40.1 | 40.1 | −183.9 |
| Mol Fraction | | | | | | | |
| Nitrogen | 0.7811 | 0.0000 | 0.0000 | 0.0000 | 0.9980 | 0.9919 | 0.0000 |
| Argon | 0.0093 | 0.0032 | 0.0604 | 0.0033 | 0.0007 | 0.0023 | 0.9810 |
| Oxygen | 0.2096 | 0.9968 | 0.9396 | 0.9967 | 0.0013 | 0.0058 | 0.0190 |

Figure 2:
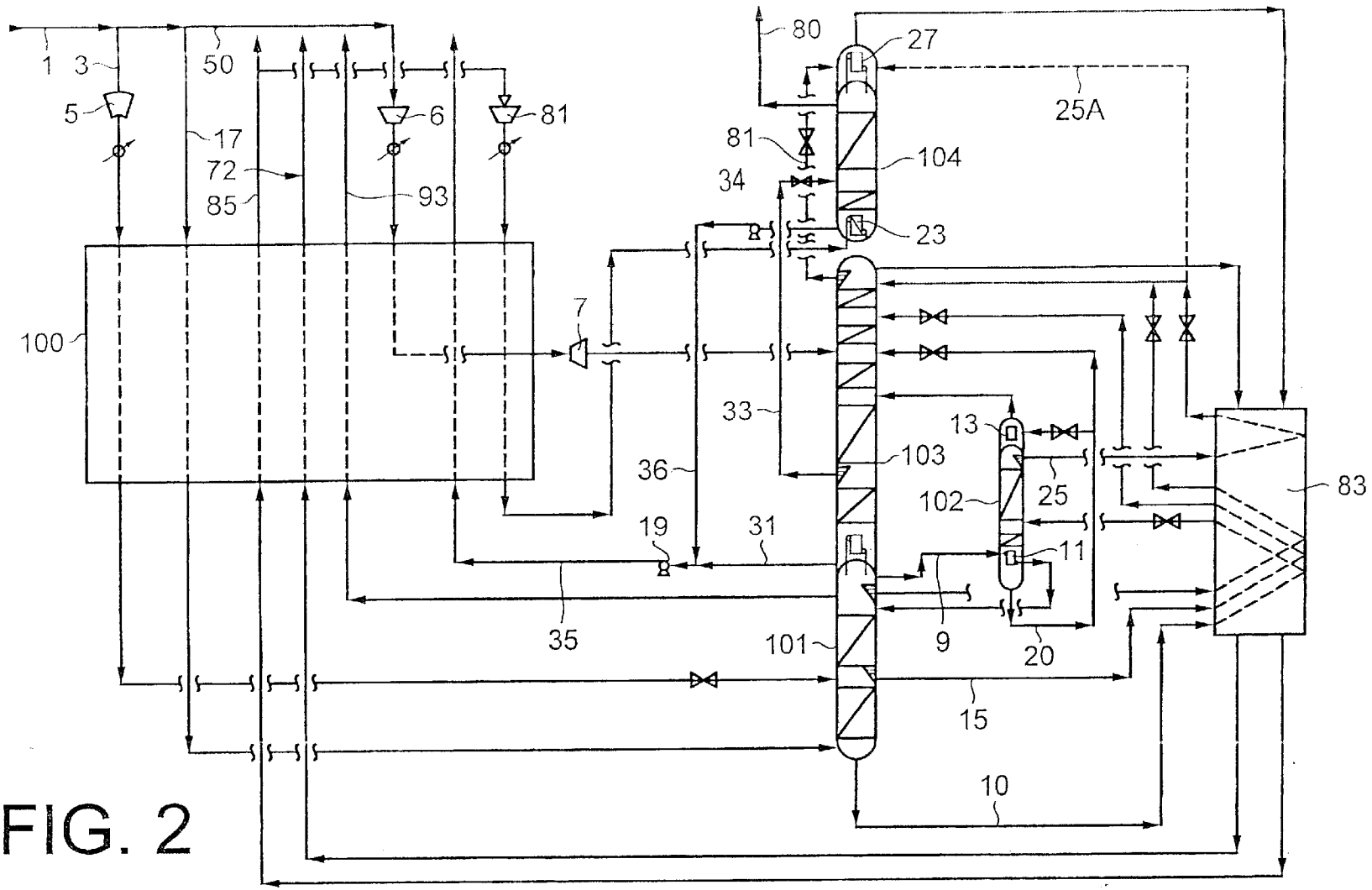

The embodiment of FIG. 2 differs from that of FIG. 1 in that the reboil of the argon column 104 is achieved by further compressing a part of stream 85 (or the nitrogen product of the low pressure column) in compressor 81 at ambient temperature, cooling the compressed stream in exchanger 100 and condensing this recycle stream at the bottom reboiler 23 of the argon column. Stream 85 contains at least 90% nitrogen. The condensed liquid is fed to the top of the low pressure column 103. This situation applies when the feed air pressure is low resulting in lower pressure in the low pressure column such that it is no longer possible to reboil the argon column with the nitrogen rich gas at the top of the low pressure column.

Figure 3:
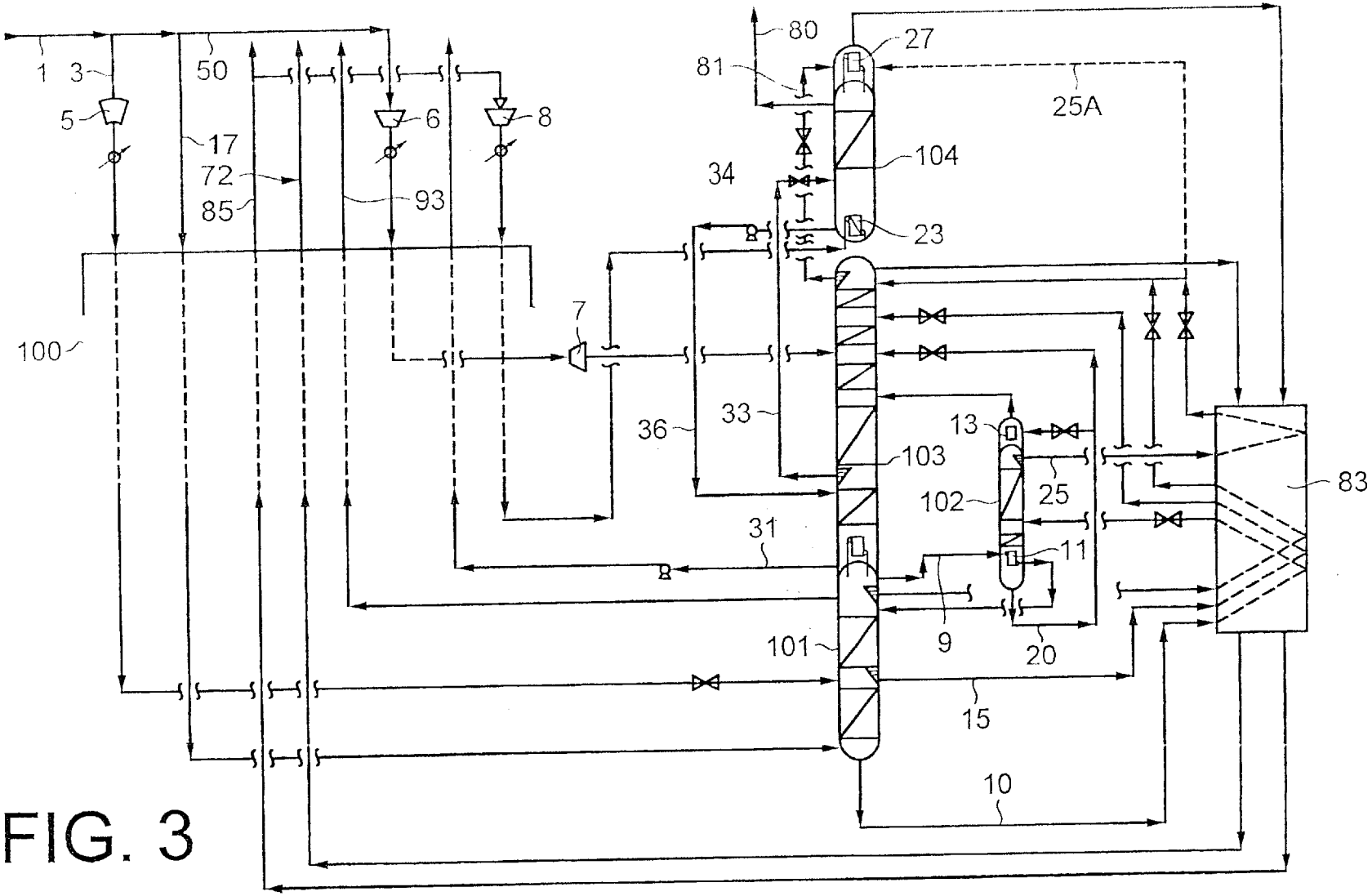

The embodiment of FIG. 3 differs from that of FIG. 2 in that instead of recovering the fourth oxygen rich stream 36 as product this stream is pumped and recycled back to the low pressure column for further distillation at the same level as the withdrawal point of stream 33. The first argon enriched stream 33 is sent to the bottom of the argon column 104.

Figure 4:
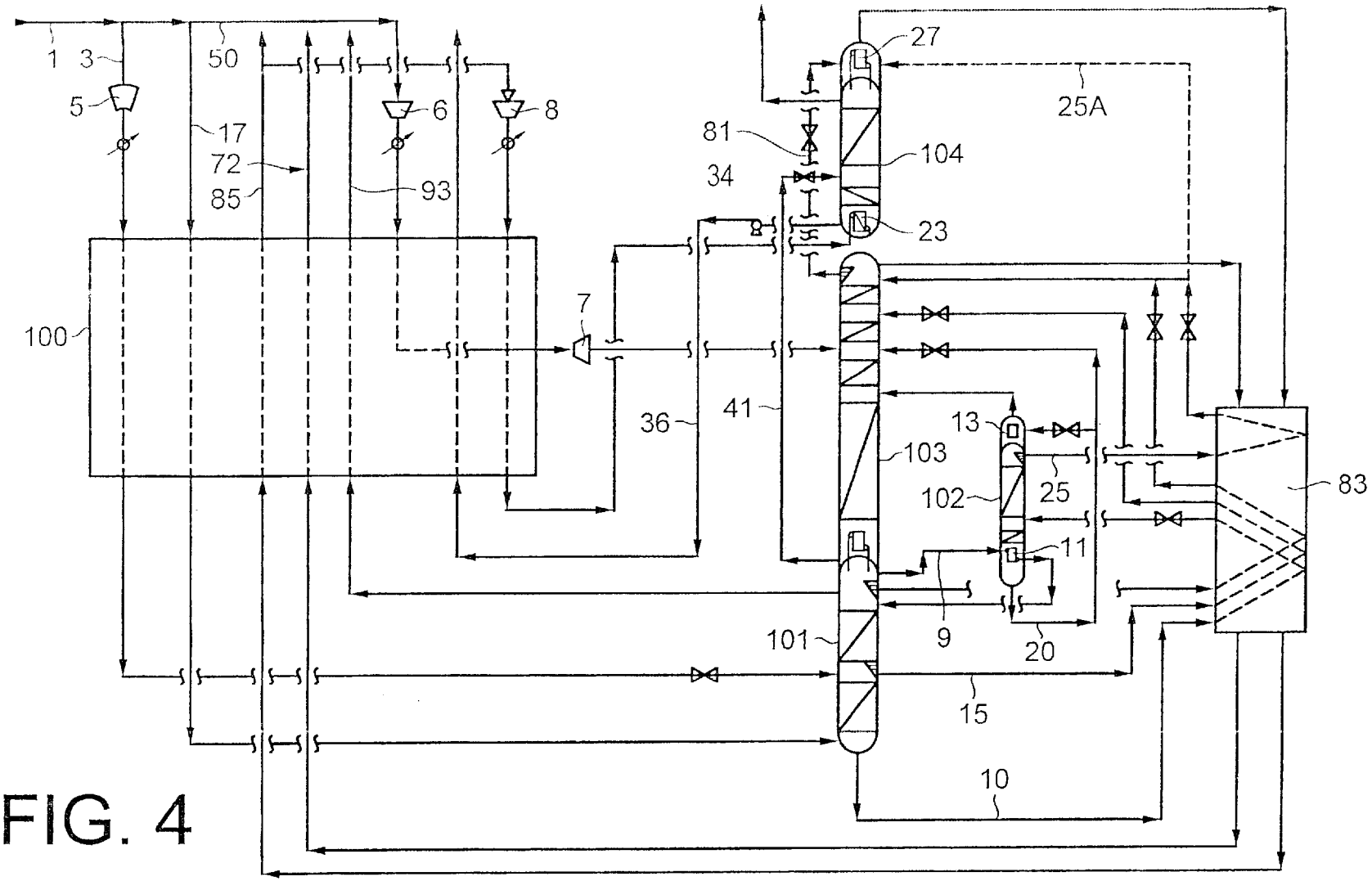

In the embodiment of FIG. 4, recycled nitrogen is used to reboil the argon column 104. The fourth oxygen enriched stream 36 is pumped and vaporized in heat exchanger without being mixed with another stream. Instead of producing the high purity oxygen product from the low pressure column, the oxygen-argon stream 41 is extracted from the bottom of the low pressure column and sent to an intermediate level of the argon column where it is distilled into high purity oxygen 36 at the bottom and argon stream 80 at the top.

Instead of producing all oxygen at high purity, it is possible to conceive a scheme where only a portion 31 is provided at high purity (i.e. over 98% oxygen) and another portion is produced at lower purity (for example 95% oxygen or less). In this situation (refer to FIG. 1) the low purity oxygen stream can be extracted directly from stream 33 or at the low pressure column 103 in the vicinity of the tray where stream 33 is extracted. This configuration allows to optimize the power consumption in function of the quantity of the pure oxygen produced.

It can be seen from the above description that the third and fourth oxygen enriched stream can be extracted as oxygen products. For the LOX pumped cycles (where the liquid oxygen is pumped to high pressure then vaporized by indirect heat exchange with high pressure air or nitrogen to yield high pressure gaseous oxygen product) one can avoid having two different sets of LOX pumps for two product streams by expanding the third liquid oxygen enriched stream into the sump of the argon column to mix with the fourth oxygen enriched material and the combined liquid oxygen stream is then pumped by a single set of pump to higher pressure. The pumped power is slightly higher but the pump arrangement is simpler and less costly.

Figure 5:
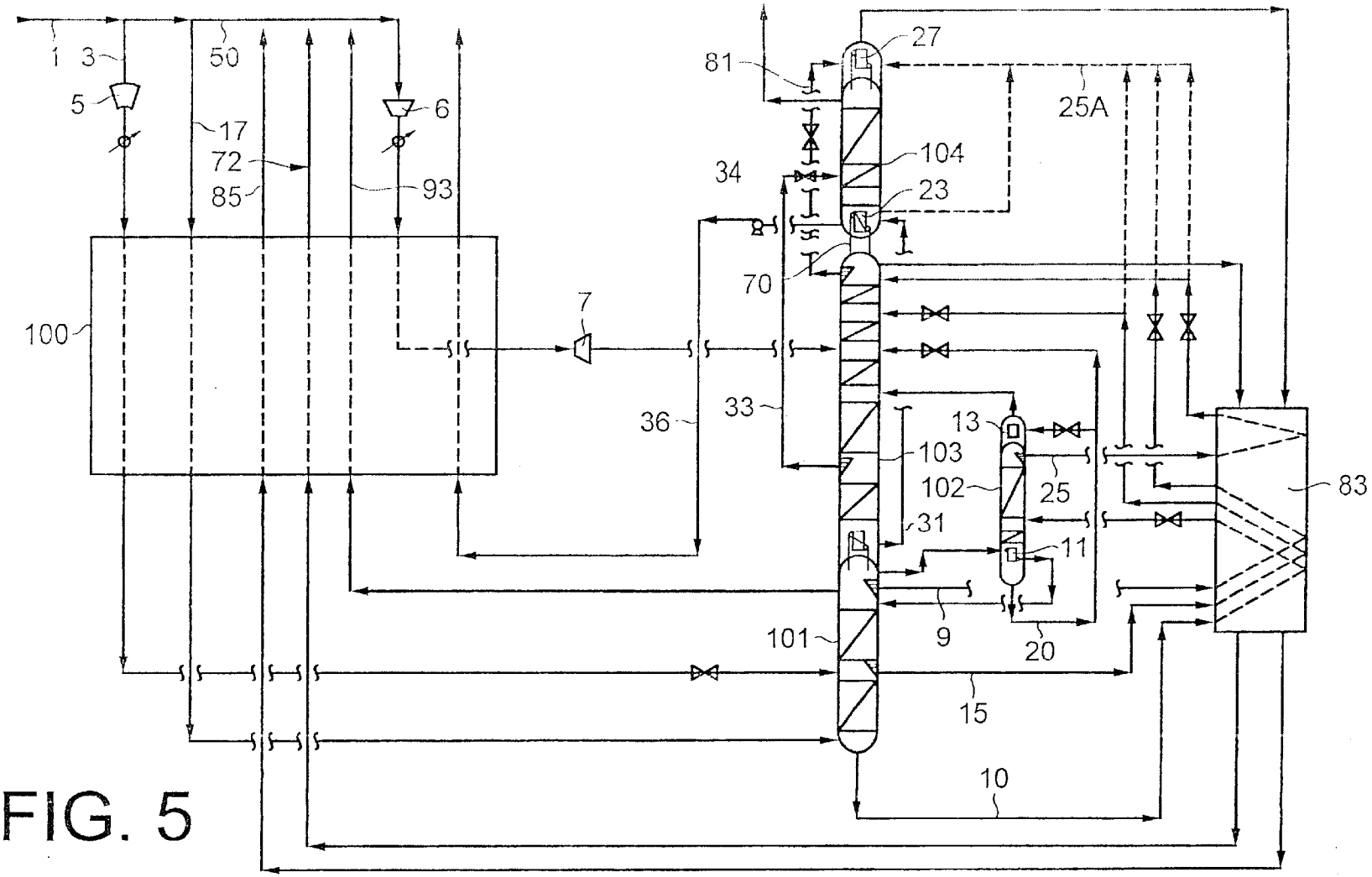

Thus as shown in FIG. 5, the third oxygen enriched stream is sent via expansion valve 34 to the bottom of the argon column in the region of reboiler. It is then withdrawn with the rest of the bottom liquid, pumped to a vaporizing pressure and evaporated in exchanger.

If however the third and fourth oxygen streams have different purities or are required at different pressures, the streams may be removed and vaporized separately.

The third and fourth oxygen enriched streams may be removed in gaseous or liquid form.

The process may be used to produce oxygen, nitrogen or argon in liquid form if sufficient refrigeration is available.

If argon is not needed one can reduce the number of theoretical trays of the argon column above the feed point of stream 33. In this situation the argon stream still contains significant concentration of oxygen (for example 50% argon and 50% oxygen), and may be discarded, used to cool the feed air or sent back to the low pressure column.

The number of trays in the low pressure column can be arranged to provide an oxygen-argon feed stream to the argon column containing less than 3 ppm, preferably 1 ppm nitrogen. The argon product will therefore not contain nitrogen (ppm range) and another column is not needed for nitrogen removal. If sufficient number of trays are installed in the argon column the argon stream can be distilled to ppm levels of oxygen content such that the final argon product can be produced directly from the argon column. This column can be of single or multiple sections with liquid transfer pumps in between sections.

In the figures, the high pressure, low pressure and argon columns form a single structure with the intermediate pressure column as a side column. It will be appreciated that the columns could be arranged differently, for example the high pressure and low pressure columns could be positioned side by side, the intermediate pressure column could form a single structure with the high and/or low pressure column etc.

The versions illustrated show the use of nitrogen enriched gas from the high pressure column to reboil the low pressure column. Of course air or another gas from one of the columns could be used to reboil the low pressure column if another reboiler is provided for condensing the nitrogen enriched gas against a liquid from further up the low pressure column.

The high pressure column may operate at between 10 and 20 bar, the intermediate pressure column at between 6 and 13, the low pressure column at between 3 and 7 bar and the argon column at between 1.3 and 2 bar.

All or some of the columns may contain structured packing of the cross corrugated type or of the Werlen/Lehman type described in EP-A-0845293.

The air to be send to the air separation apparatus may be derived from the compressor of a gas turbine or the blower of a blast furnace.

What is claimed is:

1. A process for separating air by cryogenic distillation comprising the steps of feeding compressed, cooled and purified air to a high pressure column where it is separated into a first nitrogen enriched stream at the top and a first oxygen enriched stream at the bottom, feeding at least a portion of the first oxygen enriched stream to an intermediate pressure column to yield a second nitrogen enriched stream at the top and a second oxygen enriched stream at the bottom, sending at least a portion of the second nitrogen enriched stream to a low pressure column or to a top condenser of an argon column, sending at least a portion of the second oxygen enriched stream to the low pressure column, separating a third oxygen enriched stream at the bottom and a third nitrogen enriched stream at the top of the low pressure column, sending a heating gas to a bottom reboiler of the low pressure column, removing at least a portion of the third oxygen enriched stream at a removal point, removing a first argon enriched stream containing between 3 and 20% argon from the low pressure column, sending the first argon enriched stream to the argon column having a top condenser, recovering a second argon enriched stream, richer in argon than the first argon enriched stream, at the top of the argon column and removing a fourth oxygen enriched stream at the bottom of the argon column, wherein the argon column operates at a pressure at least 0.5 bar lower than the pressure of the low pressure column.

2. The process of claim 1 wherein the argon column has a bottom reboiler heated by a gas stream.

3. The process of claim 2 wherein the gas stream contains at least 90% nitrogen.

4. The process of claim 3 wherein the gas stream heating the bottom reboiler of the argon column is at least a portion of one of the first, second and third nitrogen enriched streams.

5. The process of claim 4 comprising compressing at least a portion of nitrogen enriched gas and sending it as heating gas to the bottom reboiler of the argon column.

6. The process of claim 1 comprising removing the first argon enriched stream from the low pressure column in liquid form.

7. The process of claim 1 comprising sending the fourth oxygen enriched stream to the low pressure column.

8. The process of claim 1 comprising removing the first argon enriched stream at the bottom of the low pressure column.

9. The process of claim 1 comprising removing the third oxygen enriched stream and the second argon enriched stream as products.

10. The process of claim 9 wherein the third oxygen enriched stream contains at least 95% oxygen and the second argon enriched stream contains at least 95% argon.

11. The process of claim 1 comprising removing the first argon enriched stream at least 5 theoretical trays above the bottom of the low pressure column and removing the fourth oxygen enriched stream as a product.

12. The process of claim 11 wherein the fourth oxygen enriched stream contains at least 95% oxygen.

13. The process of claim 1 comprising sending nitrogen enriched liquid from at most twenty theoretical trays below the top of the low pressure column to the top condenser of the argon column.

14. The process of claim 1 wherein the heating gas for the bottom reboiler of the low pressure column is nitrogen enriched gas from the high pressure column or air.

15. The process of claim 1 wherein oxygen enriched streams of differing purities are removed from the low pressure column.

16. The process of claim 1 wherein the low pressure column operates at above 2 bar.

17. The process of claim 16 wherein the low pressure column operates at above 4 bar.

18. The process of claim 1 wherein the intermediate pressure column has a bottom reboiler.

19. The process of claim 18 comprising sending a nitrogen enriched gas from the high pressure column to the bottom reboiler.

20. The process of claim 1 comprising at least partially vaporizing or subcooling at least part of the second nitrogen enriched fluid before sending it to the low pressure column.

21. The process of claim 1 comprising at least partially vaporizing or subcooling at least part of the second oxygen enriched fluid before sending it to the low pressure column.

22. The process of claim 1 wherein the intermediate pressure column has a top condenser and comprising sending at least part of the second oxygen enriched fluid to the top condenser.

23. The process of claim 1 comprising sending air to the intermediate pressure column.

24. An apparatus for separating air by cryogenic distillation comprising a high pressure column, an intermediate pressure column, a low pressure column having a bottom reboiler and an argon column having a top condenser, a conduit for sending air to the high pressure column, a conduit for sending at least part of a first oxygen enriched liquid from the high pressure column to the intermediate pressure column, a conduit for sending a second oxygen enriched fluid from the bottom of the intermediate pressure column to the low pressure column, a conduit for sending a second nitrogen enriched fluid from the top of the intermediate pressure column to the low pressure column or to the top condenser of the argon column, a conduit for sending a heating gas to the bottom reboiler of the low pressure column, a conduit for removing a third oxygen enriched fluid from the low pressure column, a conduit for sending a nitrogen enriched liquid from the high pressure column to the low pressure column, a conduit for sending a first argon enriched stream from the low pressure column to the argon column, a conduit for withdrawing a second argon enriched stream from the argon column, a conduit for withdrawing a fourth oxygen enriched stream from the argon column and means for expanding the first argon enriched stream sent from the low pressure column to the argon column.

25. The apparatus of claim 24 wherein the argon column has a bottom reboiler.

26. The apparatus of claim 25 including a conduit for sending a third nitrogen enriched stream from the low pressure column to the bottom reboiler of the argon column.

27. The apparatus of claim 26 including a compressor for compressing the third nitrogen enriched stream before sending it to the bottom reboiler of the argon column.

28. The apparatus of claim 24 comprising a conduit for sending a nitrogen enriched liquid from the top of the low pressure column to the top condenser of the argon column.

29. The apparatus of claim 24 wherein the conduit for removing the first argon enriched stream is connected to the bottom of the low pressure column.

30. The apparatus of claim 24 comprising a conduit for sending the fourth oxygen enriched stream to an intermediate point of the low pressure column.

31. The apparatus of claim 24 comprising means for pressurizing at least one oxygen enriched liquid withdrawn from the argon column or the low pressure column.

32. The apparatus of claim 24 comprising conduits for withdrawing oxygen enriched streams of differing purities from the low pressure column.

33. The apparatus of claim 24 wherein the conduit for removing the first argon enriched stream is connected to an intermediate level of the low pressure column.

34. The apparatus of claim 24 comprising means for at least partially vaporizing or subcooling the second nitrogen enriched liquid before sending it to the low pressure column.

35. The apparatus of claim 24 comprising means for at least partially vaporizing or subcooling the second oxygen enriched liquid before sending it to the low pressure column.

36. The apparatus of claim 24 wherein the intermediate pressure column has a bottom reboiler.

37. The apparatus of claim 24 comprising means for sending a nitrogen enriched gas from the high pressure column to the bottom reboiler of the intermediate pressure column.

38. The apparatus of claim 24 wherein the intermediate pressure column has a top condenser.

39. The apparatus of claim 38 comprising means for sending at least part of the second oxygen enriched fluid to the top condenser of the intermediate pressure column.

40. The apparatus of claim 39 comprising means for sending air to the intermediate pressure column.

41. The apparatus of claim 24 wherein the expanding means is a valve.

42. The apparatus of claim 24 wherein the expanding means is a turbine.

43. The process of claim 1 comprising sending nitrogen enriched liquid containing at least 95% nitrogen to the top condenser of the argon column.

44. The process of claim 1 comprising sending at least a portion of the condensed nitrogen enriched stream from the bottom reboiler of the argon column to the top condenser of the argon column.

* * * * *